US007377259B2

(12) United States Patent
Tokisato et al.

(10) Patent No.: US 7,377,259 B2
(45) Date of Patent: May 27, 2008

(54) LINK STRUCTURE FOR CARBURETOR

(75) Inventors: Tomoyuki Tokisato, Saitama (JP); Makoto Shimowada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 47 days.

(21) Appl. No.: 11/546,911

(22) Filed: Oct. 13, 2006

(65) Prior Publication Data

US 2007/0084441 A1 Apr. 19, 2007

(30) Foreign Application Priority Data

Oct. 17, 2005 (JP) ..... 2005-302333

(51) Int. Cl.
*F02D 11/04* (2006.01)

(52) U.S. Cl. ..... 123/400; 261/34.2

(58) Field of Classification Search ..... 123/342, 123/400; 261/34.2; 180/219; 74/491, 513, 74/525

See application file for complete search history.

(56) References Cited

U.S. PATENT DOCUMENTS 2,145,260 A * 1/1939 High ..... 123/505
2,160,410 A * 5/1939 Blattner ..... 261/39.3
3,907,941 A * 9/1975 Herbert et al. ..... 261/23.2

FOREIGN PATENT DOCUMENTS

JP 61-167455 U 10/1986

* cited by examiner

*Primary Examiner*—T. M Argenbright
(74) *Attorney, Agent, or Firm*—Birch, Stewart, Kolasch & Birch, LLP

(57) ABSTRACT

To optimize an accelerator pump while maintaining serviceability of a carburetor. A drive lever includes an operating portion that slides in abutment along a cam projection formed on a cam and a transmitting portion for transmitting a swinging force in an increased magnitude by being provided in the vicinity of a spindle as a lever swing axis in comparison with the operating portion. A driven lever includes a receiving portion being capable of a swinging motion together with the drive lever about the spindle and receiving the swinging force by being in abutment with the transmitting portion and a connecting portion connected to an accelerator pump as a control unit thereof for controlling the flow amount of fuel are provided and the transmitting portion includes a screw mechanism for adjusting the angle formed between the drive lever and the driven lever and a cylindrical cover for covering the screw mechanism.

20 Claims, 6 Drawing Sheets

LINK STRUCTURE FOR CARBURETOR

CROSS-REFERENCE TO RELATED APPLICATIONS

The present application claims priority under 35 USC 119 to Japanese Patent Application No. 2005-302333 filed on Oct. 17, 2005 the entire contents of which are hereby incorporated by reference.

BACKGROUND OF THE INVENTION

1. Field of the Invention

The present invention relates to a link mechanism for a carburetor.

2. Description of Background Art

As disclosed in JP-UM-A-61-167455, a link structure for activating an accelerator pump as a link mechanism for a carburetor is known.

FIG. 1 of JP-UM-A-61-167455 discloses a valve shaft 8 that is rotatably mounted to an upper body 2 of a carburetor, a throttle drum 10 is mounted to the valve shaft 8, a control cable 11 is wound around the throttle drum 10 and a distal end of the control cable 11 is mounted to the throttle drum 10. One end of a link rod 15 is connected to the throttle drum 10 and a distal end of a first arm 14 of an accelerator pump arm 13 is connected to the other end of the link rod 15 via a coil spring 16. A third arm 18 is provided on the side substantially opposite from the first arm 14 with respect to a swing axis of the accelerator pump arm 13. The third arm 18 is brought into abutment with an upper end of a push rod 19 which constitutes the accelerator pump. A diaphragm 24 is connected to a lower end of the push rod 19 with a discharge side channel 29 being connected to an accelerator pump chamber 21 in which the diaphragm 24 is stored and fuel is filled. An accelerator nozzle 32 projects from an inlet port 5 that is connected to an end of the discharge side channel 29.

When the control cable 11 is quickly pulled, the throttle drum 10 rotates, the link rod 15 is pulled, the coil spring 16 is compressed to swing the accelerator pump arm 13, the push rod 19 is moved downwardly to press the diaphragm 24 downwardly, and then fuel in the accelerator pump chamber 21 is injected from the distal end of the accelerator nozzle 32 via the discharge side channel 29 into the inlet port 5.

In case of the carburetor discussed above, since the link rod 15, the coil spring 16, and the accelerator pump arm 13 are provided integrally, in order to adjust the amount of fuel injection of the carburetor according to dimensional variations in manufacture or the like of the link rod 15, the coil spring 16 and the accelerator pump arm 13 to obtain an optimal value, replacement of the link rod 15 and so on is required.

As a countermeasure, the provision of an adjusting mechanism on a movement mechanism portion of the accelerator pump to optimize a density of air-fuel mixture at the time of acceleration is considerable. However, when the adjusting mechanism is exposed to the outside, a structure to prevent erroneous adjustment is required.

SUMMARY AND OBJECTS OF THE INVENTION

It is an object of an embodiment of the present invention to optimize an accelerator pump while improving serviceability of a carburetor.

According to an embodiment of the present invention, a carburetor is provided with a throttle drum wherein a throttle wire is wound with a cam that rotates integrally with the throttle drum. A drive lever includes an operating portion that slides in abutment along a cam projection formed on the cam and a transmitting portion for transmitting a swinging force in an increased magnitude by being provided in the vicinity of a lever swing axis in comparison with the operating portion. A driven lever includes a receiving portion being capable of a swinging motion together with the drive lever about the lever swing axis and receiving the swinging force by being in abutment with the transmitting portion with a connecting portion connected to a control unit thereof for controlling the flow amount of fuel. The transmitting portion includes a screw mechanism for changing the angle formed between the drive lever and the driven lever and a cylindrical cover for covering the screw mechanism.

When the throttle wire is quickly drawn, the cam rotates integrally with the throttle drum, and the operating portion of the drive lever slides in abutment along the cam projection of the cam. Consequently, as the drive lever is swung about the lever swing axis, the transmitting portion of the drive lever transmits the swinging force to the receiving portion of the driven lever in an increased magnitude, the driven lever is swung about the lever swing axis. Thus, the connecting portion of the driven lever causes the control unit to control the flow amount of fuel.

The screw mechanism provided on the transmitting unit changes the angle formed between the drive lever and the driven lever and the cylindrical cover provided on the transmitting portion covers the screw mechanism.

The screw mechanism is covered by the cylindrical cover. Thus, the screw mechanism can hardly be exposed to the outside and an erroneous operation can be prevented.

According to an embodiment of the present invention, the screw mechanism includes an adjusting screw wherein a head of the adjusting screw is stored in the cylindrical cover and the side surface of the head is in the proximity of the inner surface of the cylindrical cover.

As an operation, since the side surface of the head is in the proximity of the inner surface of the cylindrical cover, tools other than the required specific tool cannot be inserted into the gap between the cylindrical cover and the adjustment screw. Thus, the adjustment screw cannot be rotated.

According to an embodiment of the present invention, the drive lever includes the operating portion that slides in abutment along a cam projection formed on the cam and the transmitting portion for transmitting the swinging force in an increased magnitude by being provided in the vicinity of the lever swing axis in comparison with the operating portion. The driven lever includes the receiving portion being capable of a swinging motion together with the drive lever about the lever swing axis and receiving the swinging force by being in abutment with the transmitting portion and the connecting portion connected to the control unit thereof for controlling the flow amount of fuel. The transmitting portion includes a screw mechanism for changing the angle formed between the drive lever and the driven lever and a cylindrical cover for covering the screw mechanism. Therefore, since the screw mechanism is configured to be covered by the cylindrical cover, the screw mechanism can hardly be exposed to the outside. Thus, an erroneous operation can be prevented and the flow amount of fuel can be maintained at an optimal value.

According to an embodiment of the present invention, the screw mechanism includes the adjustment screw with the head of the adjusting screw being stored in the cylindrical cover. The side surface of the head is in the proximity of the inner surface of the cylindrical cover. Therefore, tools other than the specific tool cannot be inserted into the gap between the cylindrical cover and the adjustment screw. Thus, the adjusting screw is prevented from being operated erroneously and from being changed in position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
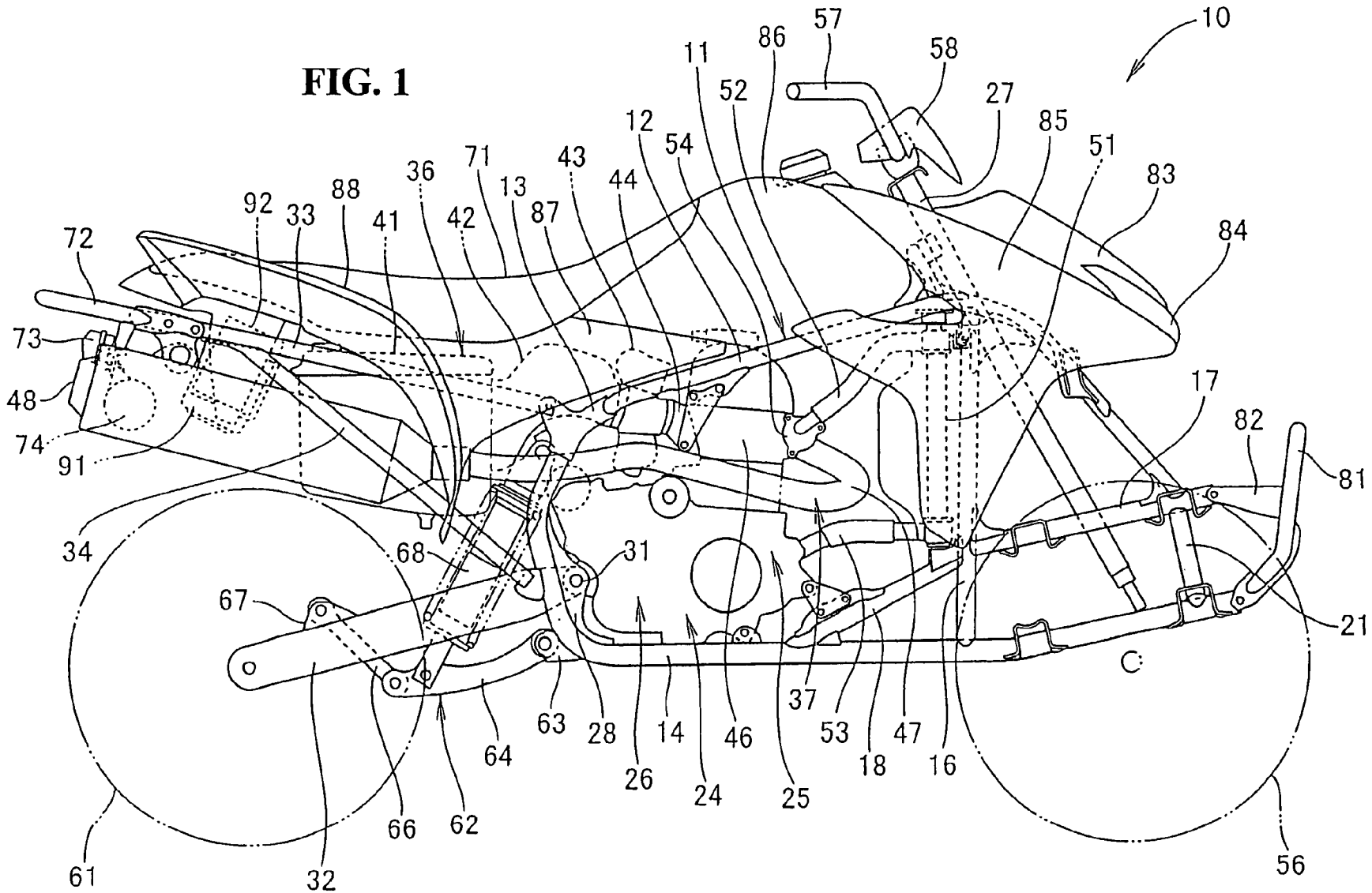
FIG. 1 is a side view of a saddle type vehicle provided with a carburetor according to the present invention.

Referring now to the drawings, a best mode for carrying out the present invention will be described. The drawings are to be viewed in an orientation in which reference numerals can be seen correctly.

FIG. 1 is a side view of a saddle type vehicle provided with a carburetor according to the present invention. A saddle type vehicle 10 is a rough-terrain vehicle provided with a vehicle body frame 11. The vehicle body frame 11 includes a pair of left and right main pipes 12 of an angular C-shape in side view (reference numerals for a pair of left and right members will be shown only for the parts on the near side, hereinafter). A pair of left and right lower pipe 14 are connected to the main pipes 12 via connecting members 13 with a pair of left and right down pipes 16 extending across the main pipes 12 and the lower pipes 14 being substantially vertical. A pair of left and right front reinforcing pipes 17 are mounted respectively to front ends of the main pipes 12 and the down pipes 16 with a pair of left and right rear reinforcing pipes 18 obliquely mounted between the down pipes 16 and the lower pipes 14. A pair of left and right front connecting pipes 21 are mounted by being connected between the front portions of the front reinforcing pipes 17 and the front portions of the lower pipes 14 respectively. A plurality of cross pipes (not shown) are provided for connecting the respective left and right members described above.

The saddle type vehicle 10 is also a vehicle configured in such a manner that a power unit 24 (including an engine 25 and a transmission 26 integrally provided on a rear portion of the engine 25) is supported by the main pipes 12, the lower pipes 14 and the rear reinforcing pipes 18. A steering shaft 27 is rotatably supported by the main pipes 12 and the lower pipes 14 with a pair of pivot plates 28 being mounted to rear portions of the main pipes 12. Swing arms 32 are mounted to the pivot plates 28 via a pivot shaft 31 so as to be capable of a vertical swinging motion. A pair of left and right seat rails 33 extend rearwardly and obliquely upwardly from the connecting members 13. Rear inclined pipes 34 are mounted so as to extend between the seat rails 33 and the lower pipes 14.

The engine 25 includes an air intake device 36 mounted to the rear portion thereof and an exhaust device 37 mounted to a front portion thereof. The air intake device 36 is configured by connecting an air cleaner 41, a connecting tube 42, a carburetor 43, and an air intake pipe 44 in sequence. The air intake pipe 44 is connected to a rear portion of a cylinder head 46 of the engine 25. The exhaust device 37 is configured by connecting an exhaust pipe 47 to a front portion of the cylinder head 46 and connecting a muffler 48 to a rear end of the exhaust pipe 47. A radiator 51 is provided together with hoses 52, 53 for connecting the radiator 51 and the engine 25. A water pump 54 is provided on the engine 25 side.

The steering shaft 27 is a member for steering left and right front wheels 56, and is provided with a bar handle 57 mounted to the upper end thereof with a handle cover 58.

The swing arms 32 are members to which left and right rear wheels 61 are mounted to the rear end portions thereof via an axle, and are connected to the lower rear portions of the lower pipes 14 via link devices 62.

The link device 62 is configured by mounting a first link 64 to link mounting member 63 provided on the lower pipe 14 so as to be capable of a swinging motion. A second link 66 is mounted to the first link 64 so as to be capable of a swinging motion. In addition, the distal end of the second link 66 are mounted to a link mounting member 67 provided on the swing arm 32.

The first links 64 are members to which ends of rear shock absorbers 68 are mounted. The other ends of the rear shock absorbers 68 are mounted to a cross pipe (not shown) extending between the left and right connecting members 13.

The seat rails 33 are members for mounting a seat 71 on top thereof and includes a grab rail 72 mounted to the rear ends thereof for allowing a rider to grip with his/her hand.

The grab rail 72 also serves as a member for supporting the muffler 48, a rear light 73 and a tool box 74.

A front bumper 81 is provided together with a bumper supporting member 82, a front cover 83, a head lamp 84, a front fender 85, a fuel tank 86, a side cover 87, a rear fender 88, a storage section 91 formed integrally with the rear fender 88, and a battery 92 arranged in the storage section 91.

Figure 2:
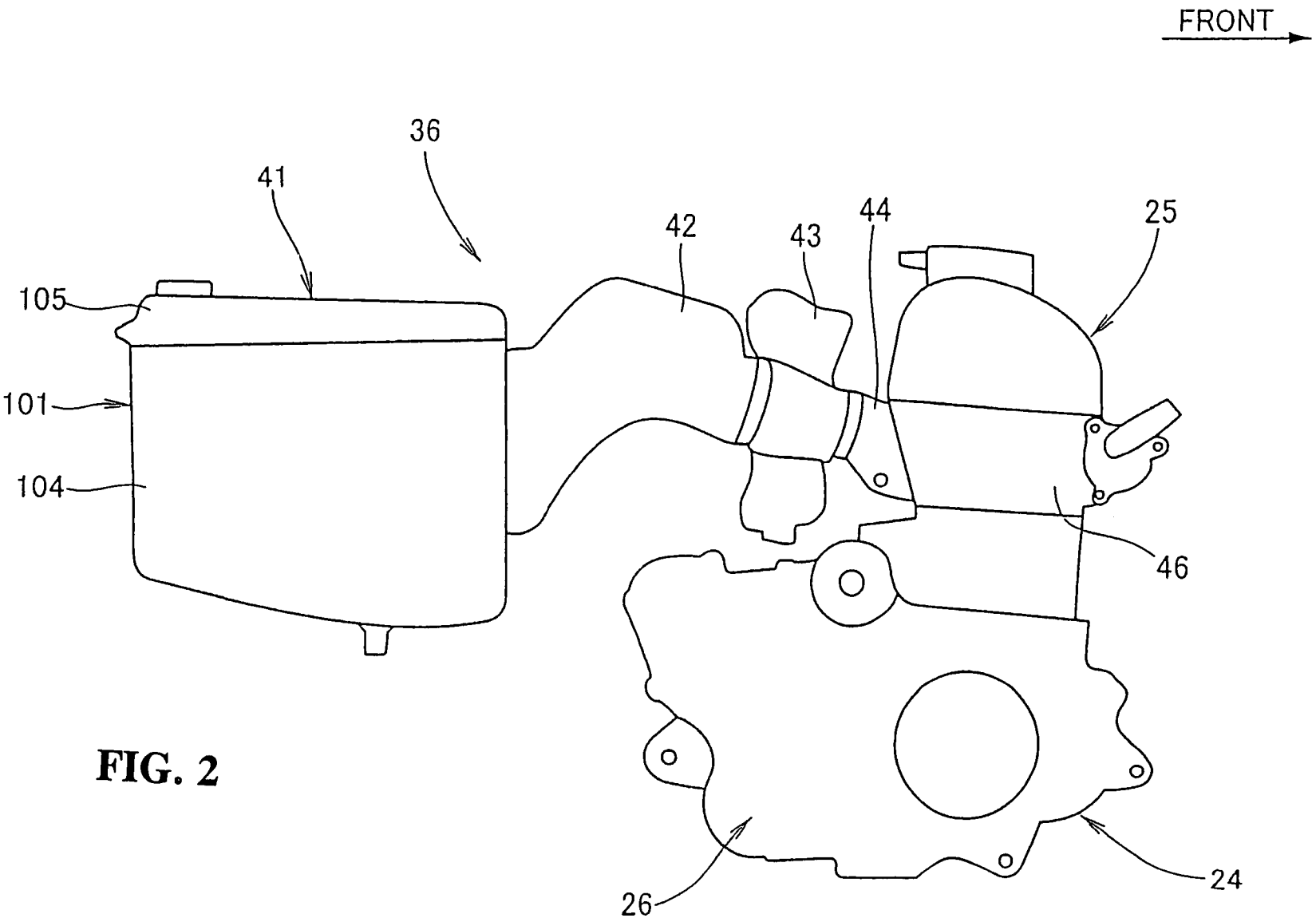
FIG. 2 is a side view of an air intake device according to the present invention.

FIG. 2 is a side view of the air intake device according to the present invention (an arrow "FRONT" in the drawing designates a front of the vehicle, hereinafter). The air intake device 36 includes the air cleaner 41 for purifying intake air, a rubber-made connecting tube 42 connected to the air cleaner 41, the carburetor 43 connected to a distal end of the connecting tube 42, and the air intake pipe 44 connected to the cylinder head 46 as well as to the carburetor 43.

In other words, the carburetor 43 is a member arranged between the engine 25 and the air cleaner 41.

The air cleaner 41 includes an air cleaner case 101 and an air cleaner element (not shown) stored in the air cleaner case 101. The air cleaner case 101 includes a case body 104 and a case cover 105 for closing an upper opening of the case body 104.

Figure 3:
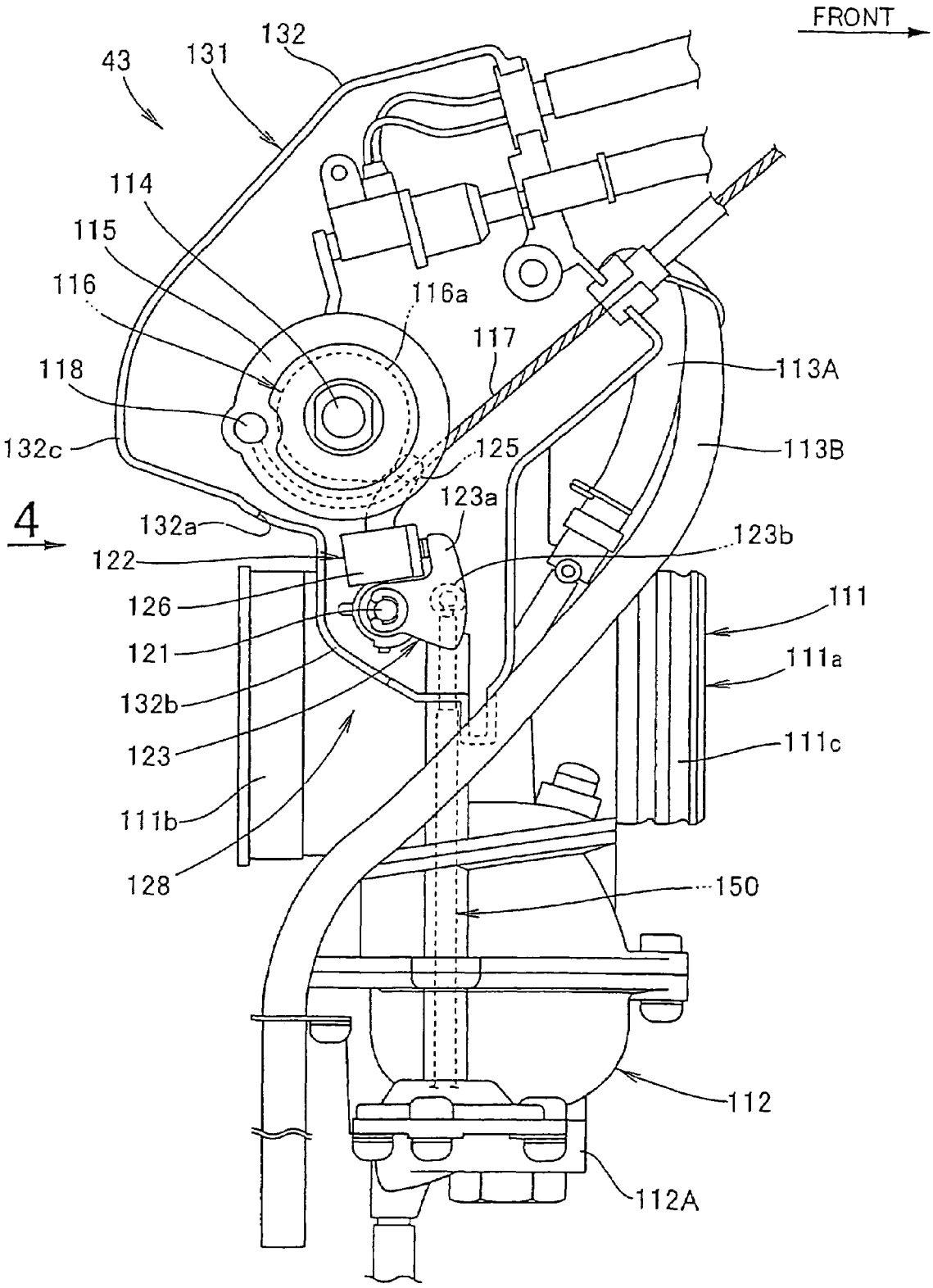
FIG. 3 is a side view of the carburetor according to the present invention.

FIG. 3 is a side view of the carburetor according to the invention. The carburetor 43 includes a casing upper half 111 provided with a main air channel for communicating with the air cleaner 41 (see FIG. 2) side and the engine 25 (see FIG. 2) side and a casing lower half 112 mounted to the lower portion of the casing upper half 111. The link structure of the present invention is provided on the casing upper half 111. A cylindrical portion 111*a* is provided integrally on the casing upper half 111 for forming the main air channel. A rear connecting portion 111*b* is provided on the cylindrical portion 111*a* for being connected to the connecting tube 42 (see FIG. 2). A front connecting portion 111*c* is provided on the cylindrical portion 111*a* for connecting to the air intake pipe 44 on the side of the engine 25 (see FIG. 2) side. Accessory hoses 113A, 113*b* are provided for releasing the interior of the carburetor 43 to the atmosphere.

More specifically, the carburetor 43 is a device configured by rotatably mounting a throttle shaft 114 to the casing upper half 111, rotatably mounting a throttle drum 115 and a cam 116 integrally joined to the throttle drum 115 to the throttle shaft 114, winding a throttle wire 117 to the throttle drum 115 and fixing a column-shaped member 118 provided at the distal end thereof to the throttle drum 115. A spindle 121 is mounted and arranged below the throttle shaft 114 to the casing upper half 111 with a drive lever 122 and a driven lever 123 being mounted to the spindle 121 so as to be capable of swinging motion. An operating portion 125 is provided at the distal end of the drive lever 122 that is brought into abutment with an outer peripheral surface 116*a* of the cam 116. A receiving portion 123*a* is pressed and provided on the driven lever 123 against a transmitting portion 126 of a swinging force provided on the drive lever 122. An accelerating pump 150 is connected to a connecting portion 123*b* provided on the driven lever 123. The above-described drive lever 122 and the driven lever 123 constitute a link mechanism 128.

The throttle drum 115, the cam 116 and the link mechanism 128 are covered by a cover member 131 mounted to the casing upper half 111. The cover member 131 includes an inner cover 132 on the side of the casing upper half 111 and an outer cover 133 (not shown) for covering an opening of the inner cover 132. A notch 132*a* is provided on the inner cover 132 with an end surface 132*b* of the notch 132*a* being located at a position lower and inner than an end surface 132*c* of the inner cover 132 other than the notch 132*a* and, in a state in which the outer cover 133 is removed from the inner cover 132. The transmitting portion 126 of the drive lever 122 and the driven lever 123 are viewable through the notch 132*a* from the rear of the carburetor 43 (see FIG. 4).

Figure 4:
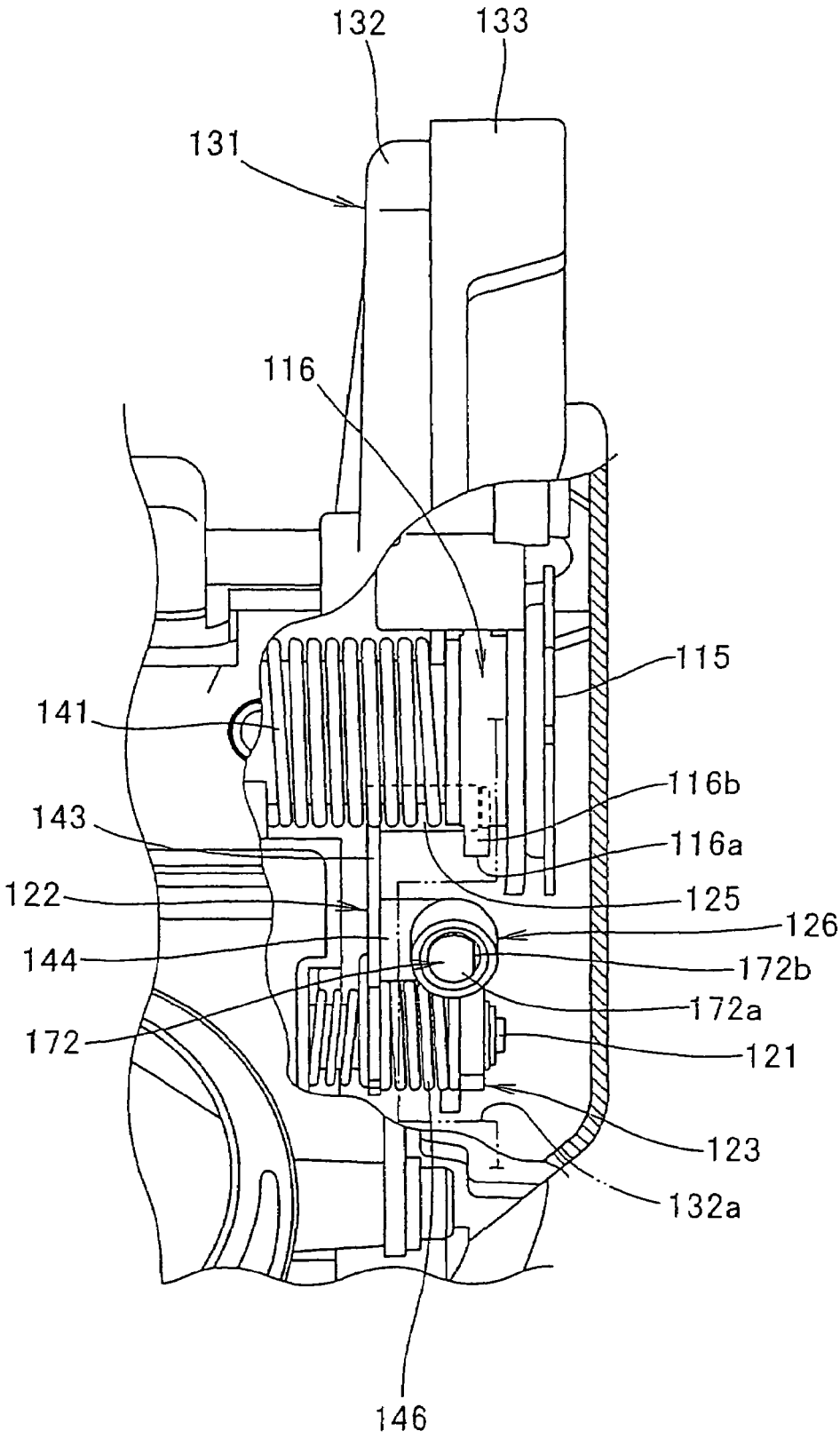
FIG. 4 is a drawing obtained by viewing in the direction indicated by an arrow 4 in FIG. 3.

FIG. 4 is a drawing obtained when viewed in the direction indicated by an arrow 4 in FIG. 3. The cam 116 is a member arranged on the inner side of the throttle drum 115 and is formed with a cam projection 116*b* integrally on the outer peripheral portion thereof. A torsion coil spring 141 is provided for urging the throttle shaft 114 (see FIG. 3), the throttle drum 115 and the cam 116 in a direction of rotation opposite from the direction of pulling the throttle wire 117 (see FIG. 3).

The drive lever 122 includes a flat plate portion 143 rotatably mounted to the spindle 121 with the pin-shaped operating portion 125 and an upright strip 144 being erected from the flat plate portion 143. The transmitting portion 126 is provided on the upright strip 144. A torsion coil spring 146 is provided for urging the drive lever 122 and the driven lever 123 in the direction of rotation (the direction to press the operating portion 125 against the outer peripheral surface 116*a* of the cam 116).

Figure 5B:
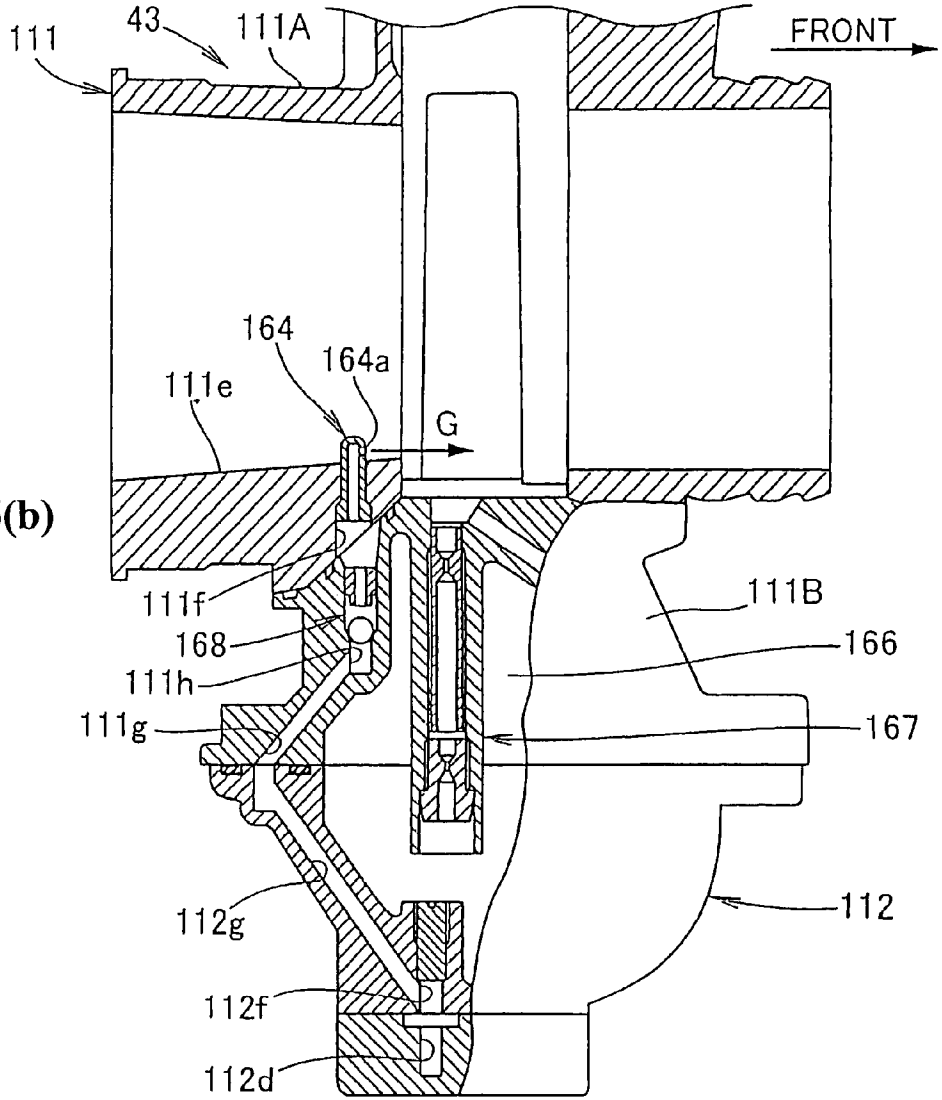
FIGS. 5(*a*) and 5(*b*) are cross-sectional views for explaining an accelerator pump according to the present invention.
Figure 5A:
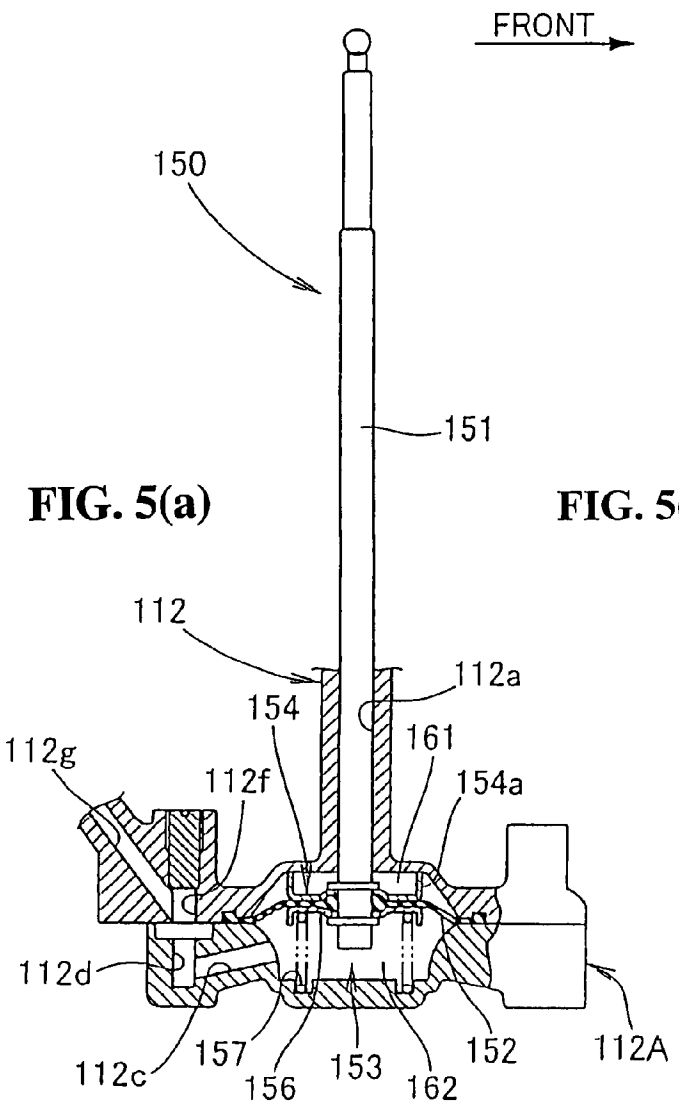

FIGS. 5(*a*) and (*b*) are explanatory cross-sectional views showing the accelerator pump according to the present invention.

FIG. 5(*a*) is a cross-sectional view of the carburetor 43 (see FIG. 3) taken along a push rod 151 which constitutes an accelerator pump 150, showing a state in which a rod supporting hole 112*a* is formed on the casing lower half 112, inserting the push rod 151 into the rod supporting hole 112*a* so as to be movable, connecting one end of the push rod 151 to the driven lever 123 (see FIG. 3), and connecting a diaphragm 152 to the other end of the push rod 151.

The diaphragm 152 is fixed by being sandwiched between the casing lower half 112 and a bottom cover 112A for covering the lower portion of the casing lower half 112 and is stored in a diaphragm chamber 153 defined by the casing lower half 112 and the bottom cover 112A, and is fixed by being clamped by two clamping plates 154, 156 at the end of the push rod 151.

One of the clamping plates 154 is provided with a stopper strip 154*a* for limiting the upward movement of the push rod 151, and the other clamping plate 156 is a member for receiving the other end of a compression coil spring 157 supported at one end by the bottom portion of the diaphragm chamber 153. The push rod 151 is in a state of being urged upwardly (toward the driven lever 123) by a resilient force of the compression coil spring 157.

The diaphragm chamber 153 includes an upper chamber 161 and a lower chamber 162 partitioned by the diaphragm 152. The lower chamber 162 is a chamber which communicates with a float chamber, described later, and is filled with fuel, and communicates with bottom channels 112*c*, 112*d* formed on the bottom cover 112A and lower-part channels 112*f*, 112*g* formed on the casing lower half 112.

FIG. 5(*b*) is a lower cross-sectional view of the carburetor 43, and the casing upper half 111 includes an upper case 111A and a lower case 111B mounted to the lower portion of the upper case 111A.

The upper case 111A includes a main air channel 111*e*, and defines an upper channel 111*f* which communicates with the main air channel 111*e* and a lower channel 111*h* described later. The upper channel 111*f* is provided with an accelerator nozzle 164. An injection port 164*a* is provided on the accelerator nozzle 164. An arrow G indicates the direction of injection of fuel from the discharge port 164*a*.

The lower case 111B is a member defining a float chamber 166 together with the casing lower half 112 for storing a float (not shown) that includes a fuel supply portion 167 at a center thereof for supplying fuel to the main air channel 111*e* with lower channels 111*g*, 111*h* which communicate with the lower-part channel 112*g* of the casing lower half 112 on a side wall. A check valve 168 is provided for allowing flow in the lower channel 111*h* from the side of the diaphragm chamber 153 of fuel (see FIG. 5(*a*)) towards the accelerator nozzle 164 and for preventing air flow from the main air channel 111*e* toward the diaphragm chamber 153.

As illustrated in FIGS. 5(*a*) and (*b*), the accelerator pump 150 includes the push rod 151, the diaphragm 152, the diaphragm chamber 153, the clamping plates 154, 156, the compression coil spring 157, the bottom channels 112*c*, 112*d*, the lower-part channels 112*f*, 112*g*, the lower channels 111*g*, 111*h*, the check valve 168, the upper channel 111*f* and the accelerator nozzle 164.

Figure 6B:
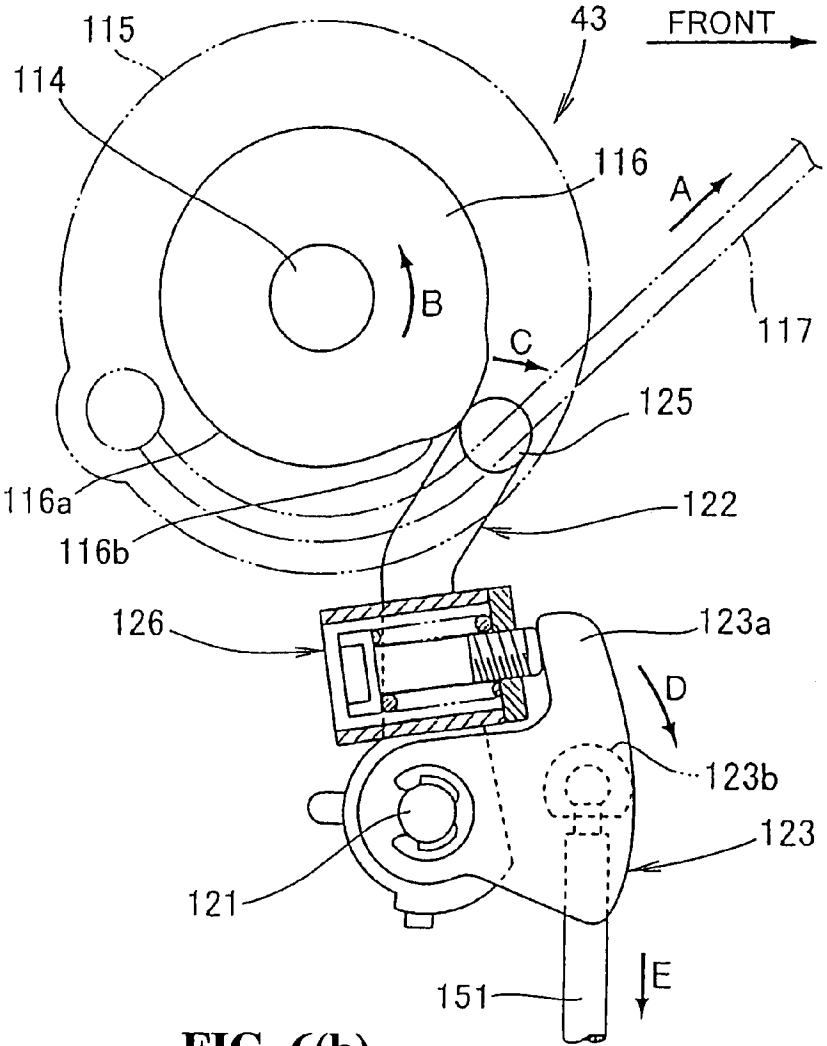
FIGS. 6(*a*) and 6(*b*) are explanatory drawings for explaining a link structure of the carburetor according to the present invention.
Figure 6A:
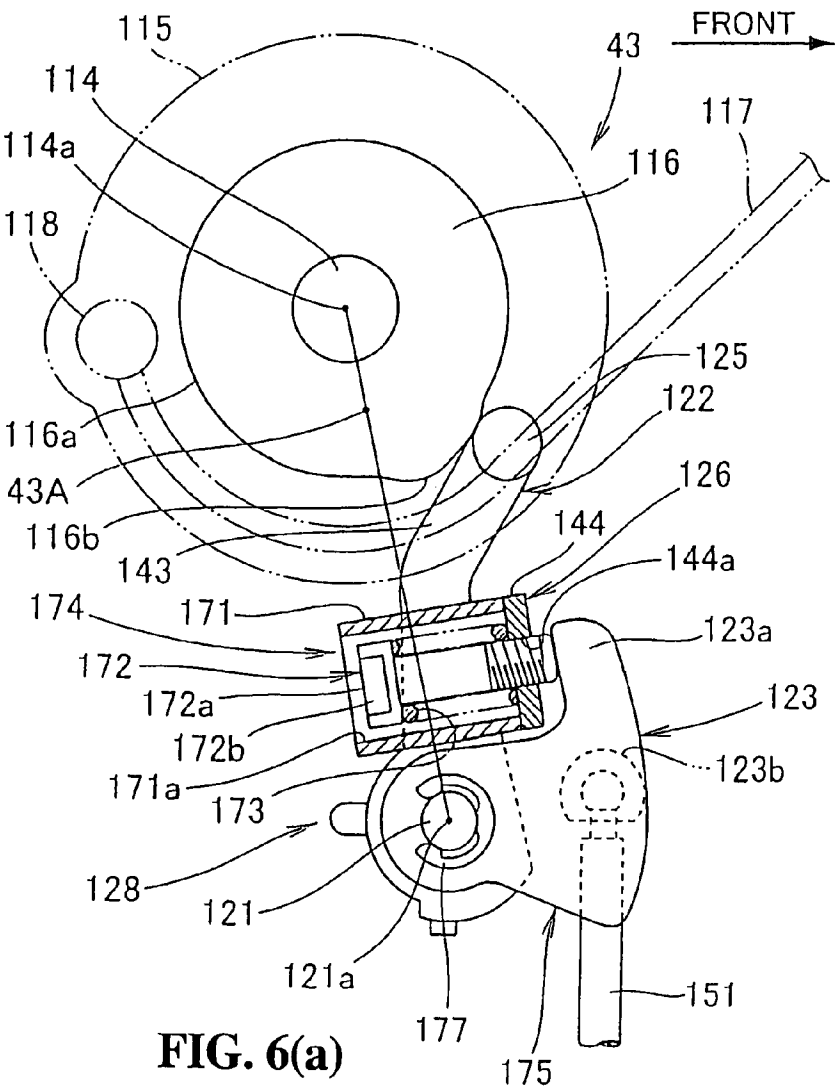

FIGS. 6(*a*) and (*b*) are explanatory drawings for explaining the link mechanism of the carburetor according to the present invention. FIG. 6(*a*) is a side view (partly in cross section) showing the link mechanism of the carburetor.

The cam 116 is a member formed with a cam projection 116*b* on the outer periphery thereof.

The transmitting portion 126 of the drive lever 122 includes a cylindrical cover 171 mounted to the upright strip 144, a female screw 144*a* formed on the upright strip 144, an adjust bolt 172 to be screwed into the female screw 144*a* and brought into abutment at the distal end thereof with the receiving portion 123*a* of the driven lever 123, and a compression coil spring 173 for restraining the loosening of the adjust bolt 172 by being interposed between a head 172*a* of the adjust bolt 172 and the upright strip 144. This forms a mechanism arranged on a segment 43A which connects an axial line 114*a* of the throttle shaft 114 (the axial line 114*a* is shown by a black circle) and an axial line 121*a* of the spindle 121 (the axial line 121*a* is shown by a black circle).

The adjust bolt 172 is a member formed with a plane 172*b* on the side surface of the column-shaped head 172*a* that can be rotated by inserting a specific tool from an opening 171*a* of the cylindrical cover 171.

The above-described female screw 144*a* of the upright strip 144, the adjust bolt 172 and the compression coil spring 173 constitute a screw mechanism 174, and the angle formed between the drive lever 122 and the driven lever 123 with the spindle 121 as a center can be changed by rotating the adjust bolt 172.

The driven lever 123 includes an L-shaped plate portion 175 mounted to the spindle 121 so as to be capable of a swinging motion. The connecting portion 123*b* is mounted to a surface on the inner side of the L-shaped plate portion 175, and is a member including the receiving portion 123*a* for receiving the swinging force from the transmitting portion 126 on the drive lever 122 side integrally with the L-shaped plate portion 175. A stop ring 177 is provided for preventing the drive lever 122 and the driven lever 123 from coming off from the spindle 121.

As shown above, the transmitting portion 126 is arranged so as to be overlapped with the segment 43A connecting the throttle shaft 114 as an axis of rotation of the throttle drum 115 and the spindle 121 as viewed in a side view.

In this manner, by arranging the transmitting portion 126 in a space between the throttle shaft 114 of the throttle drum 115 and the spindle 121 to accommodate the transmitting portion 126 in the space, and reducing the amount of the projection of the transmitting portion 126 in the carburetor 43, the transmitting portion 126 can be effectively arranged using the space between the throttle shaft 114 of the throttle drum 115 and the spindle 121, whereby the carburetor 43 can be downsized.

In addition, the accessory hoses 113A, 113B (see FIG. 3) of the carburetor 43 is arranged in front of the throttle drum 115 in the vehicle, the carburetor 43 is arranged between the engine 25 (see FIG. 2) and the air cleaner case 101 (see FIG. 2) provided in the fore-and-aft direction of the saddle type vehicle 10 (see FIG. 1). The opening 171*a* of the cylindrical cover 171 is directed to the rear of the vehicle, and the throttle drum 115 and the transmitting portion 126 are covered by the same covering member 131 (see FIG. 3).

Accordingly, by downsizing the carburetor 43, the cover member 131 is also downsized, and the drive lever 122 and the driven lever 123 can hardly be contaminated by mud, dust and the like in view of the cover member 131 being attached thereto. In addition, since the accessory hoses 113A, 113B are arranged in front of the throttle drum 115 in the vehicle, the accessory hoses 113A, 113B does not become a hindrance to servicing when servicing is carried out by removing the cover member 131.

Therefore, by downsizing of the carburetor 43, the cover member 131 can also be downsized. Thus, the cost can be reduced.

The drive lever 122 and the driven lever 123 can hardly be contaminated by mud, dust and the like in view of the cover member 131. Thus, the entering of mud, dust, rain water and the like from the opening 171*a* of the cylindrical cover 171 can be restricted, and serviceability such as assembly or disassembly of the carburetor 43 by the arrangement of the accessory hoses 113A, 113B in front of the throttle drum 115 in the vehicle can be improved.

Referring back to FIG. 4, since the transmitting portion 126 is a portion which is formed by covering the screw mechanism 174 (see FIG. 6(*a*)), more specifically, the adjust bolt 172 and the compression coil spring 173 (see FIG. 6(*a*)) with the cylindrical cover 171, when the outer cover 133 is removed, the adjust bolt 172 is not exposed to the outside except for the head 172*a*, and the compression coil spring 173 is little exposed. Therefore, the appearance can be improved.

The operation of the link structure of the carburetor 43 described above will be described below.

FIG. 6(*b*) is an operational drawing showing the operation of the link structure of the carburetor 43.

As shown by an arrow A, when the throttle wire 117 is pulled quickly, the cam 116 rotates with the throttle drum 115 in the direction indicated by an arrow B, and the operating portion 125 of the drive lever 122 comes into abutment with the cam projection 116*b* of the cam 116.

Accordingly, as shown by an arrow C, the drive lever 122 swings about the spindle 121, and the transmitting portion 126 of the drive lever 122 presses the receiving portion 123*a* of the driven lever 123. Therefore, the driven lever 123 is swung about the spindle 121 in the direction indicated by an arrow D. Consequently, the push rod 151 connected to the driven lever 123 via the connecting portion 123*b* moves downwardly as shown by an arrow E.

In FIG. 5(*a*), in association with the downward movement of the push rod 151, the diaphragm 152 sags downwardly against the resilient force of the compression coil spring 157, and the pressure of fuel in the lower chamber 162 of the diaphragm chamber 153 is increased. Therefore, the fuel in the lower chamber 162 flows along the bottom channels 112*c*, 112*d* and the lower-part channels 112*f*, 112*g* in sequence, and in FIG. 5(*b*), the fuel flows further to the lower channels 111*g*, 111*h*, flows to the upper channel 111*f* via the check valve 168, and is injected from the injection port 164*a* of the accelerator nozzle 164 into the main air channel 111*e*. Accordingly, a dense air-fuel mixture is supplied to the engine to increase the output of the engine. Thus, the vehicle is accelerated.

In the present invention, as shown in FIG. 6(*a*), since the adjust bolt 172 of the drive lever 122 and the receiving portion 123*a* of the driven lever 123 of the link mechanism 128, as a link structure for activating the accelerator pump, are connected directly to avoid interposition of a spring in partway of the link mechanism, the response of the accelerator pump 150 (see FIGS. 5(*a*) and 5(*b*)) with respect to the operation to pull the throttle wire 117 can be improved further than the related art. Thus, the output of the engine can be increased instantaneously, more specifically the engine response can be improved.

As shown in FIG. 3 and FIG. 6(*a*) described above, an embodiment of the present invention includes the carburetor 43 including the throttle drum 115 on which the throttle wire 117 is wound around, and the cam 116 which rotates integrally with the throttle drum 115. The drive lever 122 includes the operating portion 125 which slides in abutment with the cam projection 116*b* formed on the cam 116 and the transmitting portion 126 for transmitting the swinging force in an increased magnitude by being provided in the vicinity of the spindle 121 as the lever swinging axis in comparison with the operating portion 125 and the driven lever 123 having the receiving portion 123*a* being capable of swinging motion together with the drive lever 122 about the spindle 121 and receiving the swinging force by being in abutment with the transmitting portion 126 and the connecting portion 123*b* connected to the accelerator pump 150 (see FIGS. 5(*a*) and 5(*b*)) as the control unit for controlling the flow amount of fuel. The transmitting portion 126 is provided with the screw mechanism 174 for changing, that is, adjusting the angle formed between the drive lever 122 and the driven lever 123 and the cylindrical cover 171 for covering the screw mechanism 174.

Since the screw mechanism 174 is covered by the cylindrical cover 171, the screw mechanism 174 is hardly exposed to the outside. Therefore, an erroneous operation can be prevented, and the flow amount of fuel injected from the accelerator pump 150 can be maintained at an optimal value.

Since the screw mechanism 174 can hardly be exposed to the outside, the appearance can be improved, and since the screw mechanism 174 can hardly be contaminated by mud, dust, rain water and so on, durability of the screw mechanism 174 can be improved.

In addition, by employing a structure in which the transmitting portion 126 of the drive lever 122 and the receiving portion 123*a* of the driven lever 123 are separable from the spindle 121, good serviceability such as assembly or disassembly is achieved. Thus, the serviceability of the carburetor 43 can be improved.

Furthermore, since the drive lever 122 and the driven lever 123 are connected directly, the response of the accelerator pump 150 can be improved. Thus, the engine response can be improved.

Secondly, an embodiment of the present invention includes the adjust bolt 172 as the adjusting screw that is provided in the screw mechanism 174. In addition, the head 172*a* of the adjust bolt 172 is stored in the cylindrical cover 171, and the side surface of the head 172*a* is in proximity of the inner surface of the cylindrical cover 171.

Accordingly, the gap between the side surface of the head 172*a* and the inner surface of the cylindrical cover 171 is reduced. Thus, tools other than a specific tool cannot be inserted into the gap between the cylindrical cover 171 and the adjusting screw 172. Therefore, the adjusting screw 172 is prevented from being operated erroneously and hence being changed in position.

In this embodiment, as shown in FIG. 6(*a*), the drive lever 122 includes the transmitting portion 126 and the driven lever 123 includes the receiving portion 123*a*. However, the present invention is not limited thereto. It is also possible to provide the transmitting portion 126 on the driven lever, and the receiving portion 123*a* on the drive lever.

The link structure of the carburetor in the present invention is suitable for two-wheel and four-wheel vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A link mechanism for a carburetor having a throttle drum to which a throttle wire is wound and a cam that rotates integrally with the throttle drum comprising:

a drive lever having an operating portion that slides in abutment along a cam projection formed on the cam and a transmitting portion for transmitting a swinging force in an increased magnitude by being provided in the vicinity of a lever swing axis in comparison with the operating portion; and a driven lever having a receiving portion being capable of a swinging motion together with the drive lever about the lever swing axis and receiving the swinging force by being in abutment with the transmitting portion and a connecting portion connected to a control unit thereof for controlling the flow amount of fuel;

wherein the transmitting portion includes a screw mechanism for changing the angle formed between the drive lever and the driven lever and a cylindrical cover for covering the screw mechanism.

2. The link mechanism for a carburetor according to claim 1, wherein the screw mechanism includes an adjusting screw and wherein a head of the adjusting screw is stored in the cylindrical cover and the side surface of the head is in the proximity of the inner surface of the cylindrical cover.

3. The link mechanism for a carburetor according to claim 1, wherein the throttle wire is operatively secured to the throttle drum by a column-shaped member provided at a distal end thereof.

4. The link mechanism for a carburetor according to claim 1, wherein the lever swing axis is a spindle operatively mounted adjacent to an axis of said throttle drum wherein the lever swing axis and the axis of the throttle drum are aligned to be substantial parallel relative to each other.

5. The link mechanism for a carburetor according to claim 1, wherein an accelerating pump is operatively connected to said connecting portion for controlling the amount of fuel supplied to the carburetor.

6. The link mechanism for a carburetor according to claim 1, and further including a cover for covering the throttle drum, the cam and the link mechanism.

7. The link mechanism for a carburetor according to claim 1, and further including a biasing member for urging a throttle shaft, the throttle drum and the cam to rotate in a direction opposite to the direction of a pulling force applied to the throttle wire.

8. The link mechanism for a carburetor according to claim 1, and further including a biasing member for urging said drive lever and said driven lever in a direction wherein the operating portion is in engagement with the cam.

9. The link mechanism for a carburetor according to claim 2, and further including a biasing member operatively disposed within the cylindrical cover for restraining loosening of the adjusting screw.

10. The link mechanism for a carburetor according to claim 1, wherein the screw mechanism includes a priority head for mating with a priority tool to permit adjustment of said screw mechanism.

11. A link mechanism adapted to be used with a carburetor having a throttle drum to which a throttle wire is wound and a cam that rotates integrally with the throttle drum comprising:

a drive lever having an operating portion that slides in abutment along a cam projection formed on the cam and a transmitting portion for transmitting a swinging force in an increased magnitude by being provided in the vicinity of a lever swing axis in comparison with the operating portion; and a driven lever having a receiving portion being capable of a swinging motion together with the drive lever about the lever swing axis and receiving the swinging force by being in abutment with the transmitting portion and a connecting portion connected to a control unit thereof for controlling the flow amount of fuel;

a screw mechanism operatively disposed between the drive lever and the driven lever for changing the angle formed between the drive lever and the driven lever; and a cylindrical cover for covering the screw mechanism.

12. The link mechanism adapted to be used with a carburetor according to claim 11, wherein the screw mechanism includes an adjusting screw and wherein a head of the adjusting screw is stored in the cylindrical cover and the side surface of the head is in the proximity of the inner surface of the cylindrical cover.

13. The link mechanism adapted to be used with a carburetor according to claim 11, wherein the throttle wire is operatively secured to the throttle drum by a column-shaped member provided at a distal end thereof.

14. The link mechanism adapted to be used with a carburetor according to claim 11, wherein the lever swing axis is a spindle operatively mounted adjacent to an axis of said throttle drum wherein the lever swing axis and the axis of the throttle drum are aligned to be substantial parallel relative to each other.

15. The link mechanism adapted to be used with a carburetor according to claim 11, wherein an accelerating pump is operatively connected to said connecting portion for controlling the amount of fuel supplied to the carburetor.

16. The link mechanism adapted to be used with a carburetor according to claim 11, and further including a cover for covering the throttle drum, the cam and the link mechanism.

17. The link mechanism adapted to be used with a carburetor according to claim 11, and further including a biasing member for urging a throttle shaft, the throttle drum and the cam to rotate in a direction opposite to the direction of a pulling force applied to the throttle wire.

18. The link mechanism adapted to be used with a carburetor according to claim 11, and further including a biasing member for urging said drive lever and said driven lever in a direction wherein the operating portion is in engagement with the cam.

19. The link mechanism adapted to be used with a carburetor according to claim 12, and further including a biasing member operatively disposed within the cylindrical cover for restraining loosening of the adjusting screw.

20. The link mechanism adapted to be used with a carburetor according to claim 11, wherein the screw mechanism includes a priority head for mating with a priority tool to permit adjustment of said screw mechanism.

* * * * *